US007688989B2

(12) United States Patent
Willems

(10) Patent No.: US 7,688,989 B2
(45) Date of Patent: Mar. 30, 2010

(54) METHOD AND SYSTEM FOR PROCESSING SOUND SIGNALS FOR A SURROUND LEFT CHANNEL AND A SURROUND RIGHT CHANNEL

(75) Inventor: Stefan Margheurite Jean Willems, Leuven (BE)

(73) Assignee: PSS Belgium N.V., Dendermonde (BE)

( * ) Notice: Subject to any disclaimer, the term of this patent is extended or adjusted under 35 U.S.C. 154(b) by 520 days.

(21) Appl. No.: 10/598,609

(22) PCT Filed: Mar. 1, 2005

(86) PCT No.: PCT/IB2005/050750

§ 371 (c)(1),
(2), (4) Date: Sep. 6, 2006

(87) PCT Pub. No.: WO2005/091678

PCT Pub. Date: Sep. 29, 2005

(65) Prior Publication Data

US 2007/0183608 A1 Aug. 9, 2007

(30) Foreign Application Priority Data

Mar. 11, 2004 (EP) ..... 04101008

(51) Int. Cl.
*H04R 5/02* (2006.01)
*H04R 5/00* (2006.01)

(52) U.S. Cl. ..... 381/310; 381/18

(58) Field of Classification Search ..... 381/307, 381/61, 62, 63, 17, 18, 1
See application file for complete search history.

(56) References Cited

U.S. PATENT DOCUMENTS 4,308,423 A * 12/1981 Cohen ..... 381/1
5,199,075 A * 3/1993 Fosgate ..... 381/307

* cited by examiner

*Primary Examiner*—Vivian Chin
*Assistant Examiner*—Douglas J Suthers
(74) *Attorney, Agent, or Firm*—Sheehan Phinney Bass + Green, PA; Peter A. Nieves

(57) ABSTRACT

The invention describes a method for processing sound signals for a surround left channel ($S_L$) and a surround right channel ($S_R$). Thereby, a continually varying delay between the resulting signals of the surround right ($S_R$) and surround left channels ($S_L$) is generated. Furthermore the invention describes a delay management unit, a sound processing system, an acoustic system comprising such a sound processing system, a mixing unit for such an acoustic system and a studio system comprising such a sound processing system.

14 Claims, 14 Drawing Sheets

METHOD AND SYSTEM FOR PROCESSING SOUND SIGNALS FOR A SURROUND LEFT CHANNEL AND A SURROUND RIGHT CHANNEL

This invention relates to a method and system for processing sound signals for a surround left channel and a surround right channel, to a delay management unit, to an acoustic system such as a home entertainment device, an automotive sound system etc. to a mixing unit for such an acoustic system and to a sound system.

A number of sound signal processing techniques have been developed in attempts to improve the quality of sound reproduced using loudspeakers in an acoustic system, particularly for acoustic systems comprising stereo sound channels, which consist of left and right channel components. Examples of such acoustic systems are home acoustic systems such as hi-fi systems, cinema sound systems, and automobile sound systems, which all process sound channels to give sound input signals for loudspeakers. A "loudspeaker" is generally understood to be the physical device or "driver" which converts sound input signals into audible sound waves, i.e. a membrane which is caused to vibrate by an electromagnet, which is in turn activated by the sound signals. When monopole loudspeakers are used, the sound appears to originate from the direction of the loudspeakers. A dipole loudspeaker or driver comprises two sources of sound with opposite phase, separated by a small distance. A dipole loudspeaker does not radiate equally in all directions, so that its directivity pattern features two lobes indicating strong sound radiation, and other directions in which no sound is radiated. This can be realized by a loudspeaker consisting of a number of drivers grouped together. One or more loudspeakers can be housed in a "box". In the following, the term "loudspeaker" can refer to a single driver or a group of drivers, sometimes called an "array".

Stereo sound signals are converted to sound by loudspeakers usually situated to the left and right of a listener, so that the sound is directed more or less towards the left and right ears of the speaker.

Some acoustic systems attempt to deliver a better listening experience by issuing sound from an arrangement of speakers positioned at various locations around the room, e.g. Dolby Digital 2.0 or Dolby Digital 5.1, where up to six loudspeakers can be implemented—a subwoofer for bass signals, two front loudspeakers, two surround loudspeakers, and a center loudspeaker. A disadvantage of these systems is that the additional loudspeakers required must be positioned at a distance behind the listener. This is not always possible, particularly for home entertainment systems for small rooms where the listener is unable to place his seating arrangement in the middle of room to allow for the necessary separation to the rear loudspeakers. Furthermore, such loudspeakers must be connected in some way to the amplifier, which usually means unsightly lengths of cable along the ceiling or floor.

Other acoustic systems use dipole loudspeaker arrays to the front of the listener, producing different lobes for the center channel, left and right front channels, and left and right surround channels. The lobes of the surround channels are directed against the side walls, where the sound is reflected back towards the listener. Properties of the dipole loudspeaker can be used to good effect within a room to give diffuse and spacious sound reproduction. Sound reproduced in this way can give the listener the impression that he is surrounded by sound. This impression is strongest within a restricted area, known as the "sweet spot". Within the sweet spot, the listener is given the impression that the sound comes from all around, so that it does not appear to issue directly from the loudspeakers. However, the quality of the perceived sound decreases rapidly outside of the sweet spot, and coloration or distortion is often perceived due to interference of the left and right surround channel components arising as a result of the constant discrepancy in distance traveled by the different components of the stereo signals.

Therefore, an object of the present invention is to provide enhanced surround sound perception in a broad listening area.

To this end, the present invention provides a method for processing sound signals for a surround left channel and a surround right channel, wherein a continually varying delay between the signals of the surround right and surround left channels is generated. The delay, which serves to decorrelate the surround left and right channels, might vary periodically, in which case it may oscillate on a very slow time-scale such as several tens of seconds. Equally, it may have a random or pseudo-random nature. The decorrelation gives the effect of enhanced surround sound perception, since the resulting "sweet spot" is no longer restricted to a small area, but is spread over a larger area. The continual decorrelation of the surround signals ensures that the listener will not be subjected to undesirable mono effects, which can arise in other systems where the surround signals are not decorrelated.

It is a central point of the invention that the left and right surround channels are processed independently of each other, unlike other commonly know methods in which a difference signal taken between right and left surround channels is delayed before adding in, in an attempt to create a more spacious effect.

Since delaying the left and right components of the stereo surround channel in this manner results in enhanced surround sound perception, the adjective "enhanced" can be used when referring to the surround channel or its left and right components in the following to avoid confusion with other types of delay in other sound signal processing steps.

To achieve this enhanced surround sound perception by decorrelating the surround channels, a delay management unit might be used to provide a continually varying delay between the signals of the surround right channel and the surround left channel of a stereo surround channel. The continually varying delay might be generated by inserting variable delay units into the signal paths of the left and right surround channels, and might oscillate periodically, or might equally well be of a random nature. The variable delay units and other elements of the delay management unit might be realized in the form of a circuit comprising integrated circuits and/or analogue circuitry, or might be realized using software comprising digital signal processing modules. Preferably, the delay management unit might be constructed using the most suitable combination of software modules and digital and/or analogue hardware elements.

The dependent claims and the subsequent description disclose particularly advantageous embodiments and features of the invention.

In a relatively simple embodiment of the invention, each surround signal is delayed in its entirety, i.e. over its entire frequency range, with respect to the other surround signal. Here, the entire left surround channel is delayed with respect to the entire right surround channel.

To ensure that the varying delays introduced into the left and right surround channels are effectively different from each other at any time, the continually varying delay is preferably generated so that the left and right surround channels are at all times decorrelated. This might be achieved by thoroughly computing the required delays and monitoring them to ensure that they are consistently different. However, in a preferred cost-effective embodiment of the invention, the left surround channel and the right surround channel are each split into a number of frequency bands, and each frequency band of each surround channel is delayed with respect to other frequency bands of the same channel, and also with respect to a corresponding frequency band of the other channel. By splitting the channels into component frequency bands in this way and delaying each frequency band by a different amount, an even better decorrelation is achieved. For example, each surround channel might be split into low-, middle-, and high-frequency bands. The low-frequency band of one channel is then delayed against the middle-frequency band, and also against the high-frequency band, so that the delay between each combination of two frequency bands of the same channel is different. Furthermore, since each frequency band is delayed by a different amount, the delays between each combination of frequency bands of the left and right surround channels are also different.

An appropriate delay management unit for generating enhanced left and right components for the surround channel of an sound processing system comprises a frequency splitting arrangement for the left surround signal and for the right surround signal splits each signal into a number of frequency bands and variable delay units in each surround channel and a control signal generator with control signal outputs connected to the variable delay units in such a way as to yield the continually varying delay between left and right surround channels, so that each frequency band of each surround signal has its own variable delay unit, each of which is controlled by its own control signal input.

The control signals used for controlling the variable delay units are generated by a control signal generator, which might contain a dedicated signal source, realized in hardware or software, or might use an already existing signal present in the audio processing system. This signal might be periodic in nature, or might equally well be a random or pseudo-random signal, and is used directly to control one of the variable delay units. In a cost-effective version, the control signal generator comprises only one signal source and a series of modification elements, used to derive the control signals for the remaining delay units by performing a series of modifications on the original control signal. The output of each modification element can be used as a control signal input as well as the input to the next modification element, so that each control signal is different from all the rest. A modification might comprise increasing or decreasing the amplitude of a control signal, for example by doubling or by halving, or it might involve phase-shifting the control signal to delay it for a specific amount of time.

Since the original control signal is altered in successive steps by the sequence of modification elements, each of the resulting control signals differs from the rest in amplitude and phase. This ensures that each variable delay unit has a unique control signal input. The amplitude of the input control signal is interpreted as a value of time, for example, the higher the amplitude of the control signal, the longer the delay applied by the variable delay unit to its associated frequency band. Thus, each channel, or each frequency band of each channel—left and right—is delayed by a different amount. Furthermore, since the amplitude of the original control signal is constantly changing, the amplitude of each of the modified control signals is also always changing. As a result, the frequency bands are continually delayed with respect to each other by varying amounts.

A delay management unit according to the present invention can be incorporated in any sound processing system which is used to process sound signals, for example in an acoustic system such as a home entertainment system like a hi-fi system and/or TV system, in a studio system, or an automobile acoustic system.

A studio system comprising such a sound processing system might for example be in a radio/TV or recording studio environment, where signals for various sound channels are mixed for radio/TV program or cinema soundtracks. The studio system might also be used to store a soundtrack incorporating enhanced surround sound channels—for example a movie soundtrack or simply music—on a memory medium, together with any accompanying tracks such as video, for later use. Such a memory medium might be a compact disc (CD), digital video disc (DVD), video cassette, memory stick, hard-disk etc. The soundtrack might also be stored in a means suitable for downloading from the internet, for example, for movies on a pay-per-view basis, or for music soundtracks for an online music downloading service.

The surround sound signals can be processed in a delay management unit of the sound processing system according to the present invention before mixing with the other sound channels to incorporate enhanced surround sound in the soundtrack. In this way, a listener does not necessarily have to have an acoustic system with a sound processing system at home containing such a delay management unit in order to enjoy enhanced surround sound perception. Even if such a soundtrack, produced using decorrelated surround signals, is played from CD, DVD etc. and input to an sound processing system which also comprises a delay management unit according to the present invention, the surround signals are effectively subjected to a second decorrelation, which does not have any adverse effects on the quality of the reproduced sound.

A preferred acoustic system for producing enhanced surround sound, for example, in a home environment, comprises a source of a number of distinct input sound channels, an sound processing system according to the invention for processing the sound channels and a number of loudspeakers for converting the processed sound channels into audible sound. The sound channel inputs for such an acoustic system might comprise a mono channel, a bass channel, a stereo front channel, and a stereo surround channel, where the stereo channels comprise left and right signals. The signals might be processed and mixed in the sound processing system in such a way as to give sound signals to drive the loudspeakers.

The loudspeakers of the acoustic system can be distributed over a number of boxes, each containing loudspeaker arrays. For example, in a typical constellation, a single subwoofer loudspeaker containing a single driver is used for reproducing bass sound, whereas a left and a right box, each of which might contain a number of loudspeaker drivers (loudspeaker arrays), are used to reproduce sound comprising left and right components of the stereo channels, respectively. In such an arrangement, some mixing of the channel components of the different channels is carried out in order to attain any desired dipole directivity for the loudspeaker arrays. To achieve this, the enhanced surround channel is mixed with other sound channels, e.g. the center channel and the left and right front channels, and forwarded in such a way to a number of loudspeakers, so that conversion to audible sound waves results in dipole loudspeaker lobes with the desired directional arrangement. For example, an input sound signal for a loudspeaker array on the right-hand side might be obtained by mixing the right channel component of the front stereo channel in a particular manner with the center channel and the enhanced right channel component of the surround stereo channel. Similarly, a sound signal for a loudspeaker array on the left-hand side might be obtained by mixing the left channel component of the front stereo channel in a particular manner with the center channel and the enhanced left channel component of the surround channel. The signals mixed in this way contain components of more than one stereo channel, so that the loudspeaker arrays driven by these signals exhibit the desired dipole behavior, with a number of different lobes for the center channel, right and left front channel, and right and left surround channels.

To this end, the sound processing system of the acoustic system comprises a mixing unit for mixing the input sound channels to give sound output channels, and forwarding the mixed and unmixed (bass) sound channels to the loudspeakers in such a way as to yield the desired directional arrangement of dipole loudspeaker lobes.

Such a mixing unit might take the form of a signal unit or entity suitable for insertion into an existing sound system. The mixing unit might comprise line inputs for the sound channels and line outputs for connection to loudspeakers, as well as a means for mixing the sound channels to give sound output channels in such a way as to yield a directional arrangement of dipole loudspeaker lobes.

In a particularly preferred embodiment, the mixing unit comprises a user-configurable delay arrangement to allow the user of the acoustic system to delay the different sound channels with respect to each other in such a way as to direct the dipole loudspeaker lobes for at least some of the sound channels. To this end, the user might be able to specify information relating to the relative positions of the loudspeakers and the user, by entering the relevant data by means of a suitable user interface. This information might then be converted into an appropriate form, such as suitable values for delay and scale elements in the delay arrangement, to result in the desired directivity of the loudspeaker lobes.

The delay management unit according to the present invention for the purposes of enhancing the perception of surround sound by introducing a continually varying delay between the surround right and surround left signals, might be incorporated in this mixing unit, or might precede the mixing unit as a stand-alone unit.

A sound processing system according to the present invention or an acoustic system comprising such a sound processing system might perform some of the sound signal processing steps described above by implementing software modules or computer program products. Such a computer program product might be directly loadable into the memory of a programmable sound processing system, such as might be found in a home hi-fi system, PC, or a recording studio sound system, etc. Some of the units or modules for processing the sound channels and introducing a variable delay into the surround signals can thereby be realized in the form of computer program modules. Since any required software or algorithms might be encoded on a processor of a hardware device, an existing sound processing system might easily be adapted to benefit from the features of the invention. Alternatively, the components for processing sound channels in the manner described can equally be realized using hardware modules.

Other objects and features of the present invention will become apparent from the following detailed descriptions considered in conjunction with the accompanying drawing. It is to be understood, however, that the drawings are designed solely for the purposes of illustration and not as a definition of the limits of the invention.

Figure 9A:
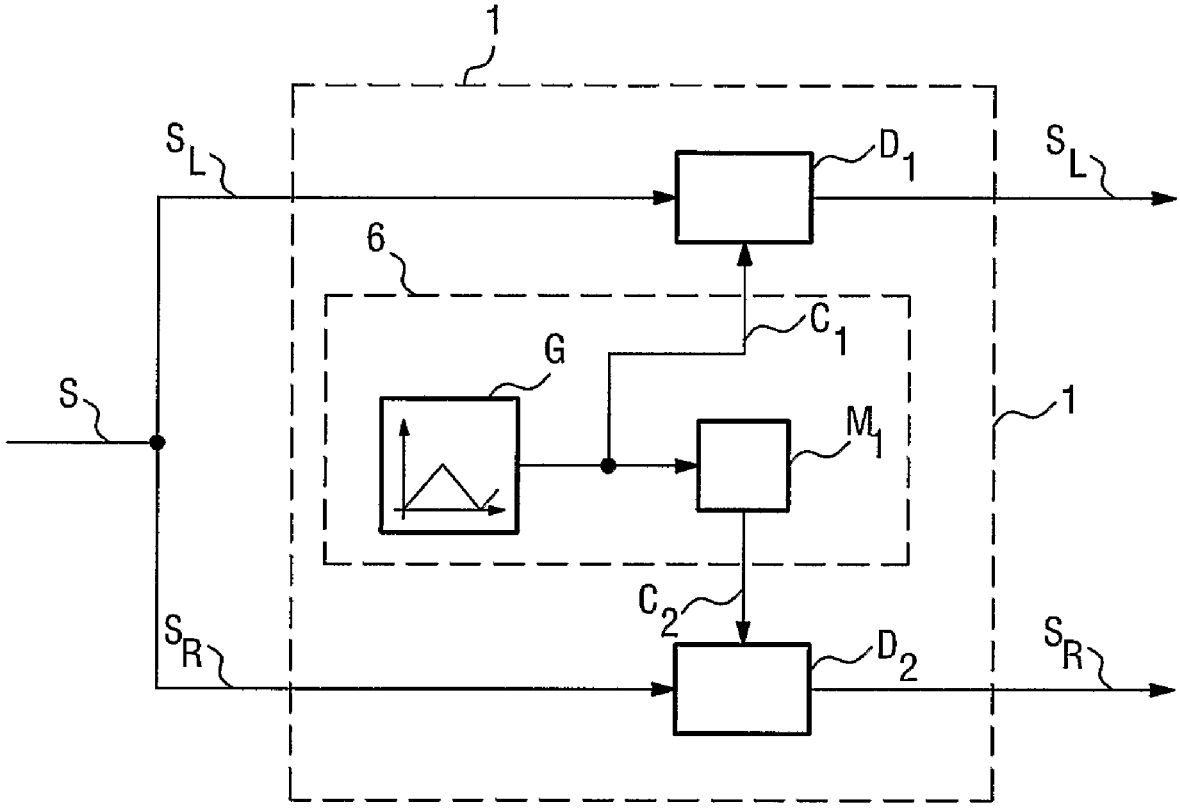
Figure 9B:
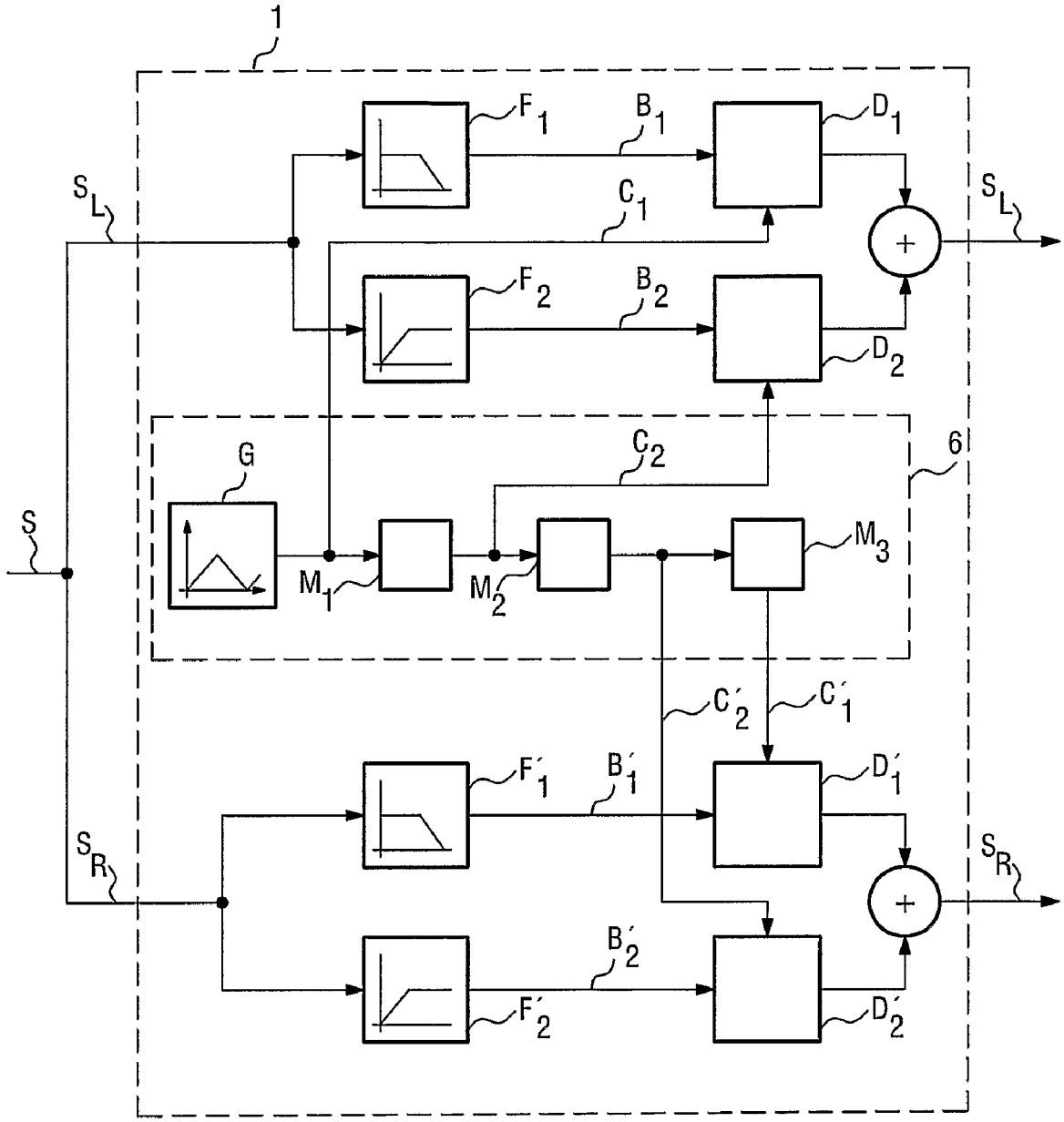
Figure 9C:
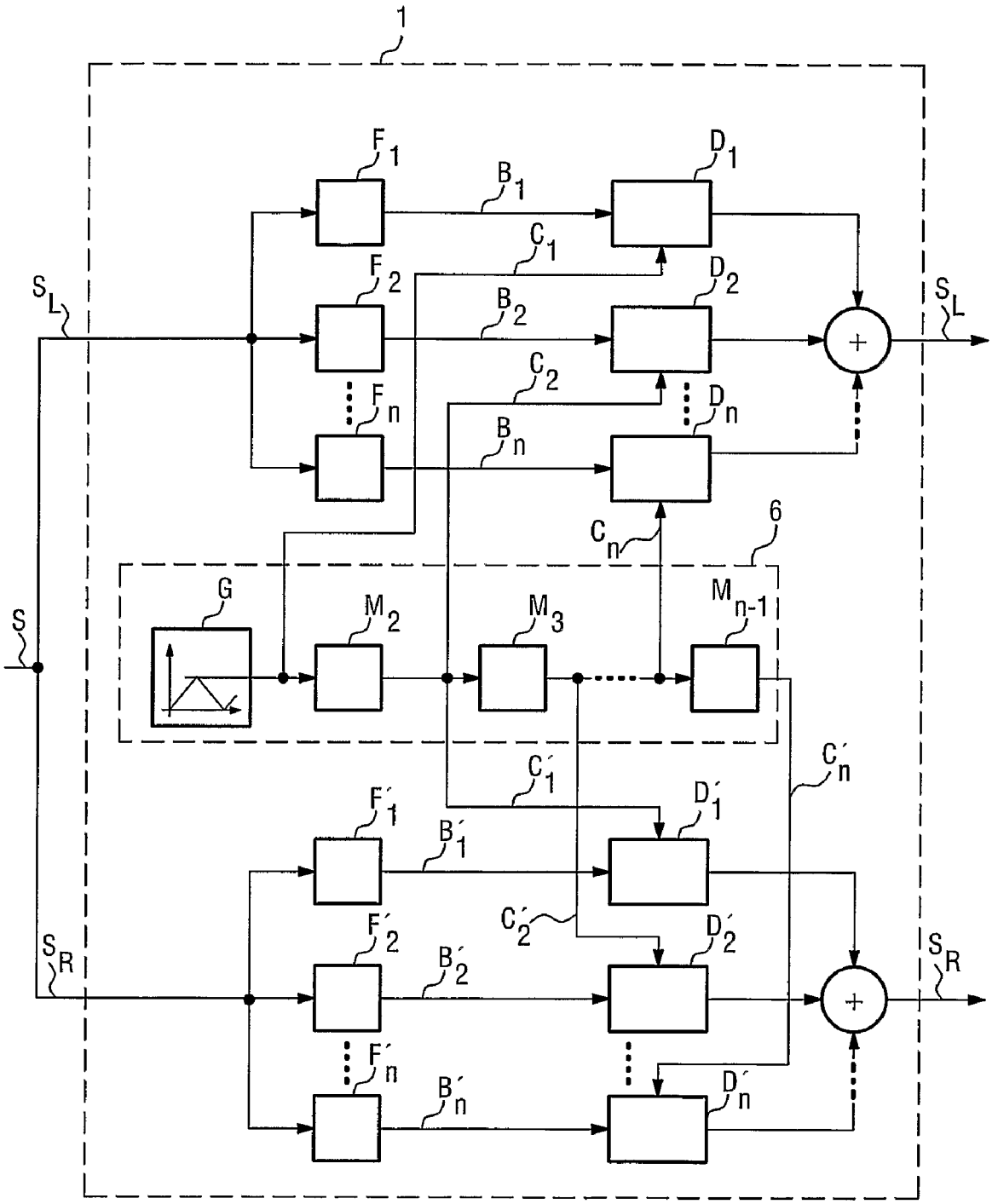
Figure 10:
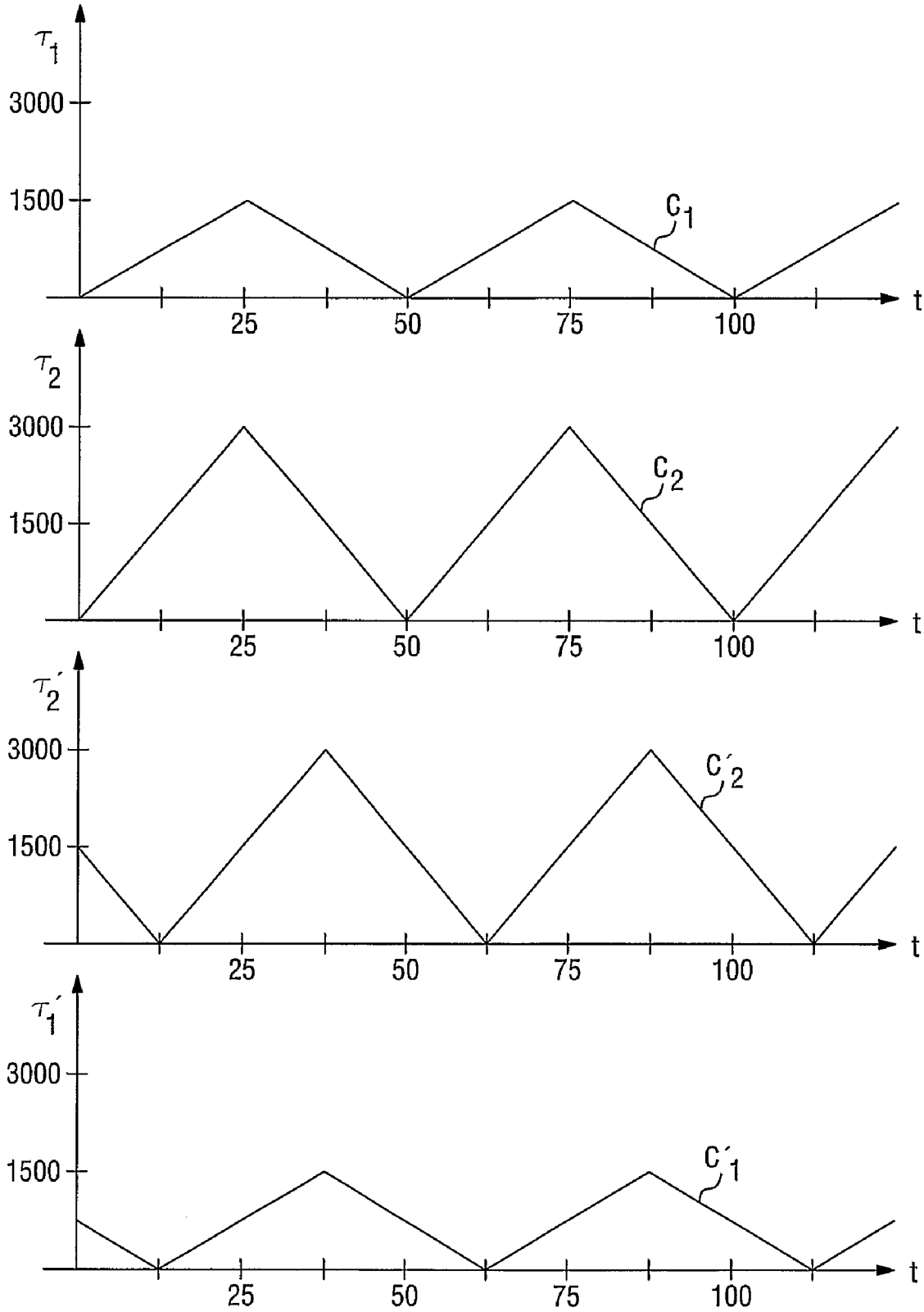

FIG. 9*a* is a block diagram of a delay management unit in accordance with a first embodiment of the present invention;

FIG. 9*b* is a block diagram showing a delay management unit in accordance with a second embodiment of the present invention;

FIG. 9*c* is a block diagram showing a delay management unit in accordance with a third embodiment of the present invention;

FIG. 10 shows graphs of control signals for the delay units in a delay management unit according to FIG. 9*b;*

Figure 12:
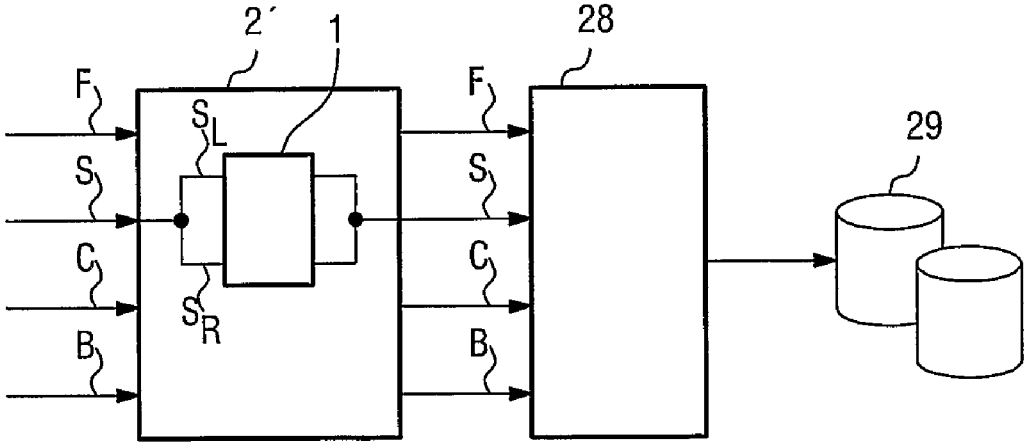

FIG. 11*a*, FIG. 11*b*, FIG. 11*c*, FIG. 11*d* and FIG. 11*e* are schematic diagrams showing loudspeaker arrangements in accordance with embodiments of the present invention;

FIG. 12 is a block diagram of a studio sound system.

Throughout the description of the figures, a lower-case reference character "L" denotes the left component of a stereo sound channel, and a lower-case reference character "R" denotes the right component. Like numbers throughout the figures refer to like components.

Figure 1:
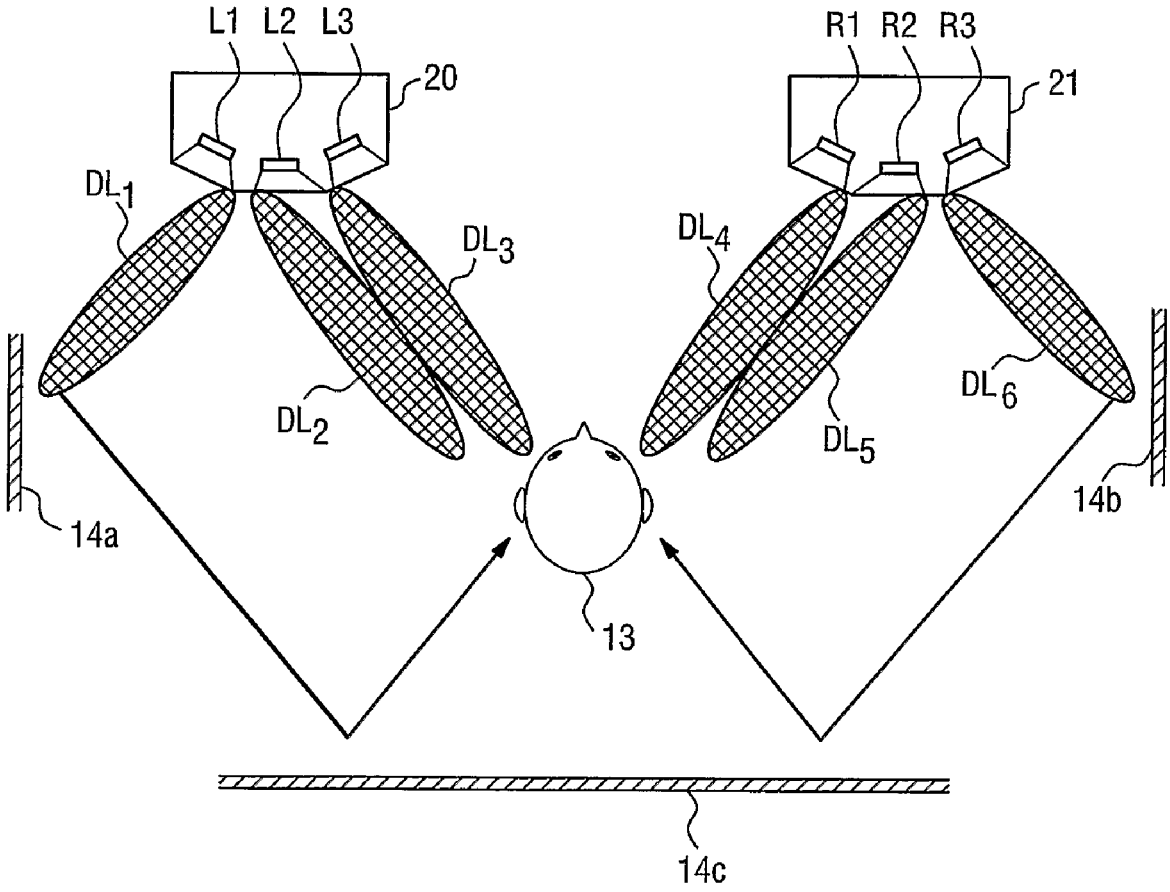
FIG. 1 is a schematic diagram showing a loudspeaker arrangement with associated dipole lobes and path of reflection of the surround sound off the surrounding walls towards the listener's position.

FIG. 1 shows a loudspeaker arrangement from above, where the arrangement comprises loudspeaker boxes 20, 21 containing loudspeakers L1, L2, L3, R1, R2, R3. For the purposes of illustration, dipole lobes $DL_1$, $DL_2$, $DL_3$, $DL_4$, $DL_5$, $DL_6$ of the loudspeaker arrays are also drawn in the figure. By applying appropriate mixing techniques, the dipole lobes $DL_1$, $DL_2$, $DL_3$, $DL_4$, $DL_5$, $DL_6$ of the speakers L1, L2, L3, R1, R2, R3 can be directed towards or away from the listener 13 to influence the quality of sound perception. Here, the center dipole lobes $DL_3$, $DL_4$ and front stereo dipole lobes $DL_2$, $DL_5$ are directed towards the listener 13. The rear surround lobes $DL_1$, $DL_6$ L1, R3, on the other hand, are directed away from the listener 13 and towards the surrounding walls $\mathbf{14}_a$, $\mathbf{14}_b$, $\mathbf{14}_c$ of the room so that the sound waves do not travel directly towards the listener 13, but rather are bounced off the surrounding walls $\mathbf{14}_a$, $\mathbf{14}_b$, $\mathbf{14}_c$ whereby the resulting scattering and reflection generate a diffuse sound effect, giving an impression of sound coming from all around.

Figure 2:
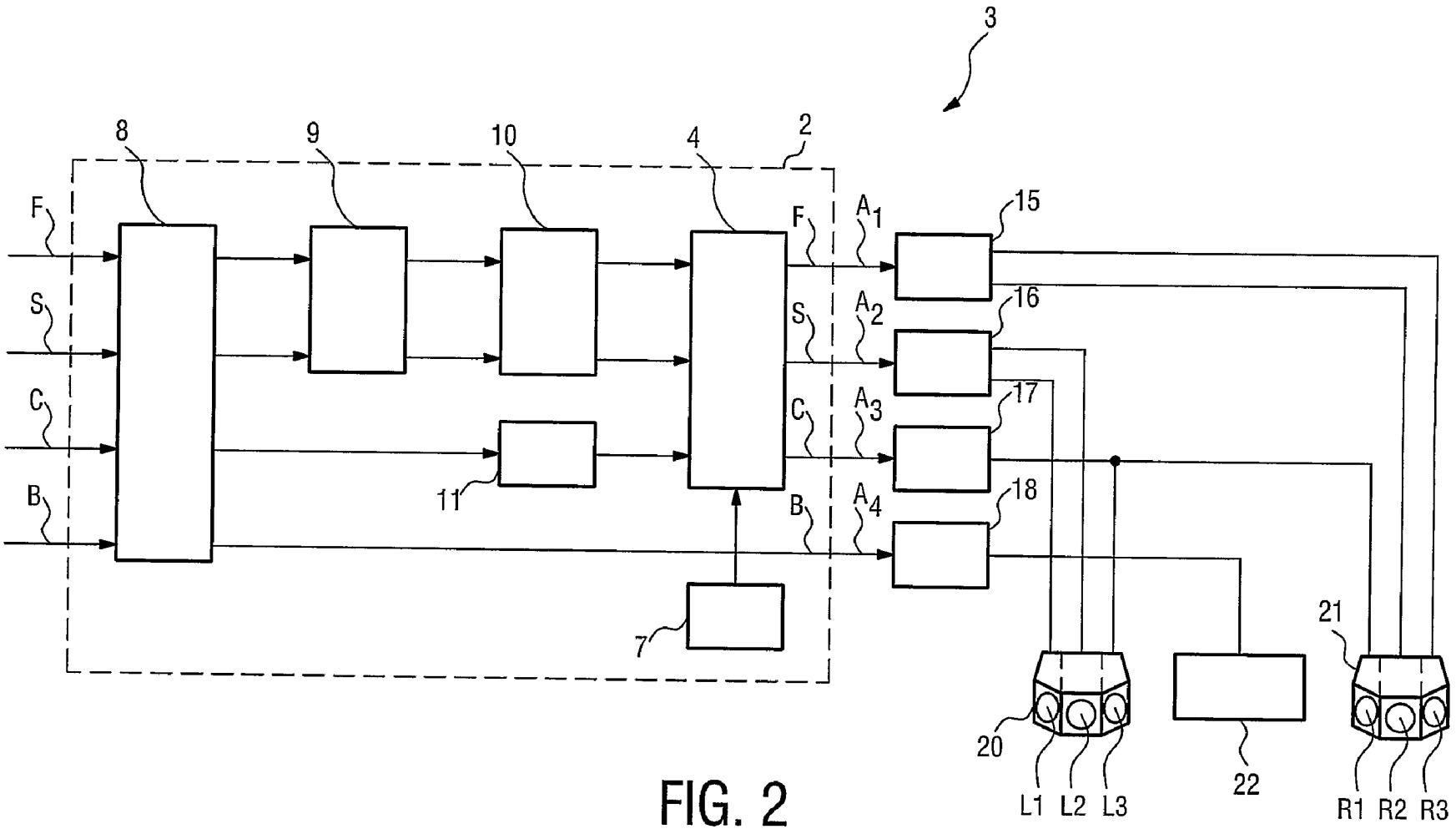
FIG. 2 is a schematic diagram of an acoustic system in accordance with an embodiment of the present invention.

FIG. 2 shows an acoustic system 3 for stereo sound reproduction as might be found in a hi-fi system for home use, in an automobile, in a cinema, etc. Input signals of different sound channels F, S, C, B which might originate from an external source such as cable or satellite, or from an internal source such as a tuner, VCR, DVD, CD-ROM, movie sound-track etc., are processed by an sound processing system 2 to give modified output sound channels $A_1$, $A_2$, $A_3$, $A_4$ which are amplified by amplifiers 15, 16, 17, 18 before being converted to audible sound in a loudspeaker arrangement 20, 21, 22. The input sound channels typically comprise stereo channels F, S, a center mono channel C and a bass channel B. The stereo channels are front F and rear surround S channels which in turn comprise left $F_L$, $S_L$ and right $F_R$, $S_R$ components.

In FIG. 2, various distinct processing stages 8, 9, 10, 11, 4 are shown.

Figure 3:
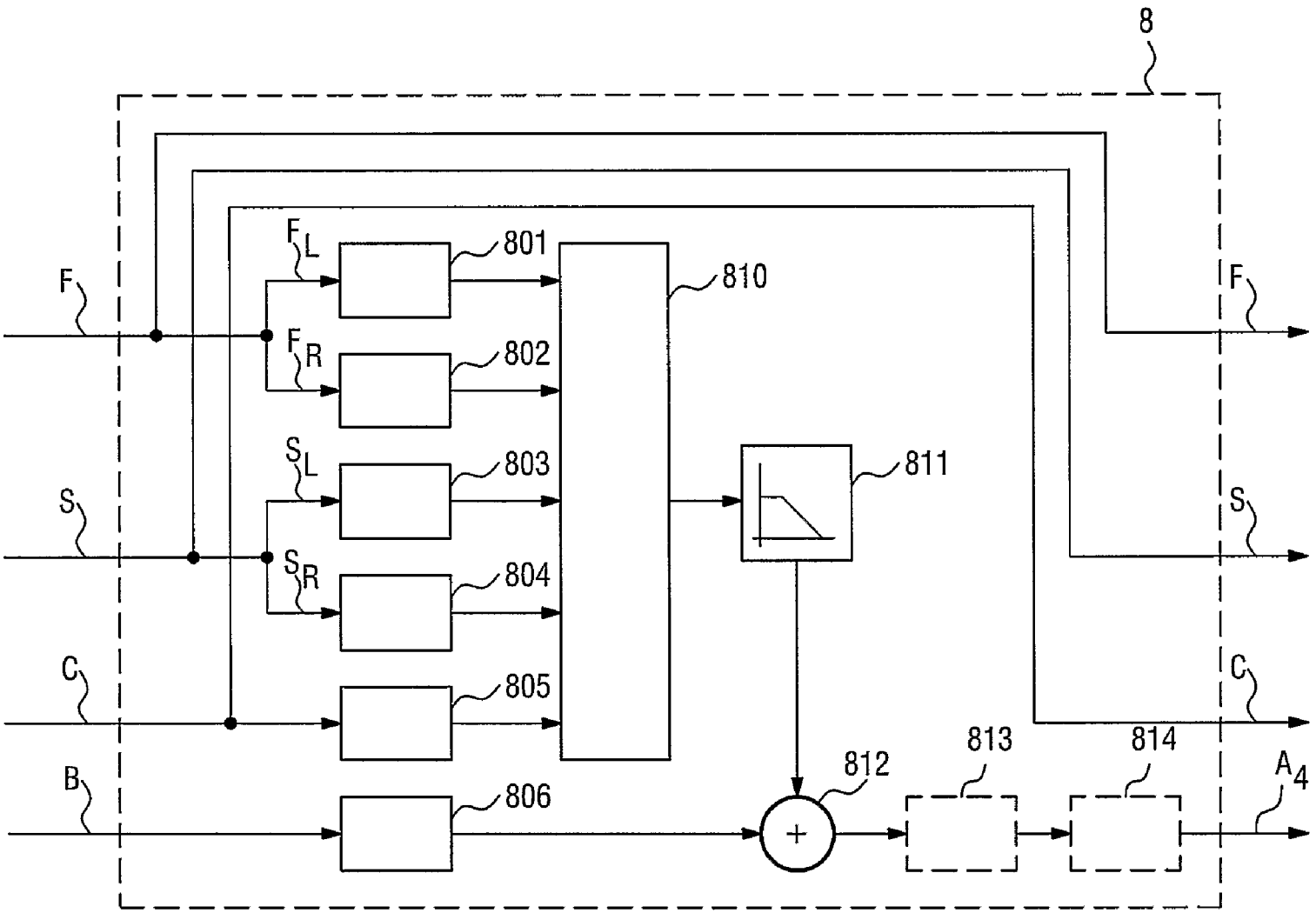
FIG. 3 is a block diagram of a bass redirection module.

FIG. 3 shows a first stage 8 for cross-over and bass management, where some processing is performed on the signals of the input channels F, B, C and B to obtain an optimal low-frequency or bass signal $A_4$, for input to the amplifier 18 assigned to the subwoofer 22, for which the low frequencies are boosted as desired while ensuring that an overloading of the amplifier 18 will not arise. First, the input signals of all channels $F_L$, $F_R$, $S_R$, $S_L$, C and B are scaled in blocks 801 . . . 806 to avoid clipping. Apart from the bass channel, all of the main channels are summed together in a summation block 810. The result of the summation is forwarded to a low-pass filter 811, the output of which is summed together with the scaled bass signal in a summation block 812. A following band-pass filter 813 is used to block frequencies below the tuning frequency of the subwoofer 22. Bass signals are further enhanced by a bass automatic level controller (ALC) 814, the parameters of which are chosen to suit the subwoofer 22 being used. The output $A_4$ of the bass ALC requires no further processing before amplification. The band-pass filter 813 and bass ALC 814 can be implemented in analogue circuitry.

Figure 4:
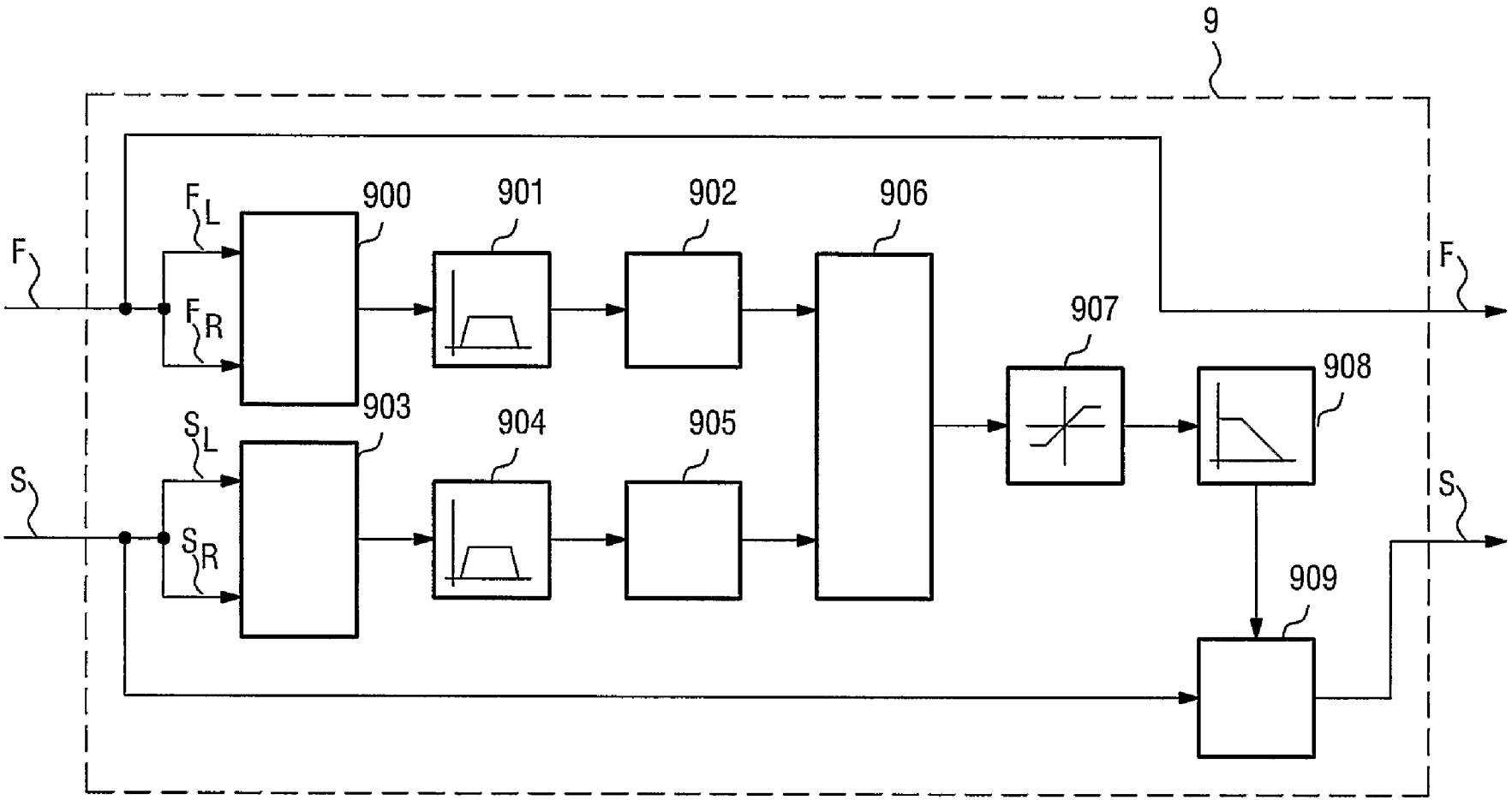
FIG. 4 is a block diagram of an energy rebalance module.

The next stage of sound processing system 2 FIG. 2 is an energy rebalance block 9, shown in detail in FIG. 4. The level of the surround channel S is boosted proportionally to the level of the front channel F in order to give the listener a maximum surround experience. To this end, the left and right components $F_L$, $F_R$ of the front channel F are scaled in a scaling block 900 and forwarded to a band-pass filter 901. The mean of the resulting signal is calculated in a mean calculation block 902. Similarly, the left and right components $S_L$, $S_R$ of the surround channel S are scaled in a scaling block 903 forwarded to a band-pass filter 904, after which the mean of the resulting signal is calculated in a mean calculation block 905. The output of the mean calculation block 902 for the front channel F is divided by the output of the mean calculation block 905 for the surround channel S, by block 906, to give an energy quotient for the two channels. This is then passed first through a saturation filter 907 and then through a low-pass filter 908 to discard unwanted higher frequencies. The output of the low pass filter is then used to scale the level of the input surround channel S, in block 909, to give a modified output signal of the surround channel S. The parameters for the processing stages in the energy re-balance block 9 are chosen carefully so that the resulting energy level of the output signal of the surround channel S never exceeds the energy level of the front channel F. In this way, the mixing of the original sound signals is respected.

Figure 5:
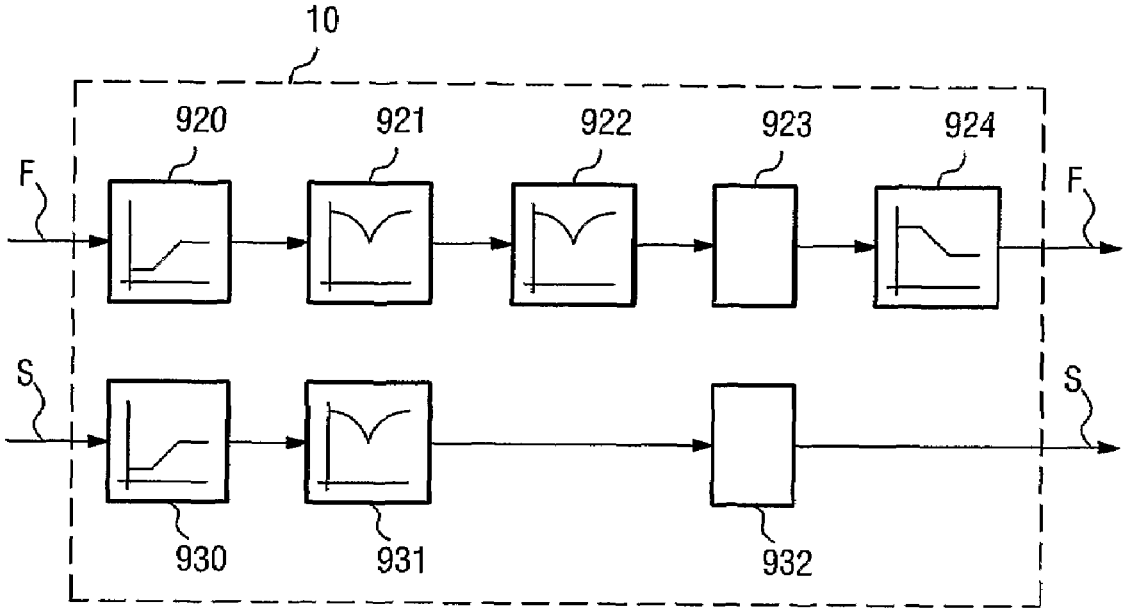
FIG. 5 is a block diagram of a front/rear cross-over and equalization.
Figure 6:
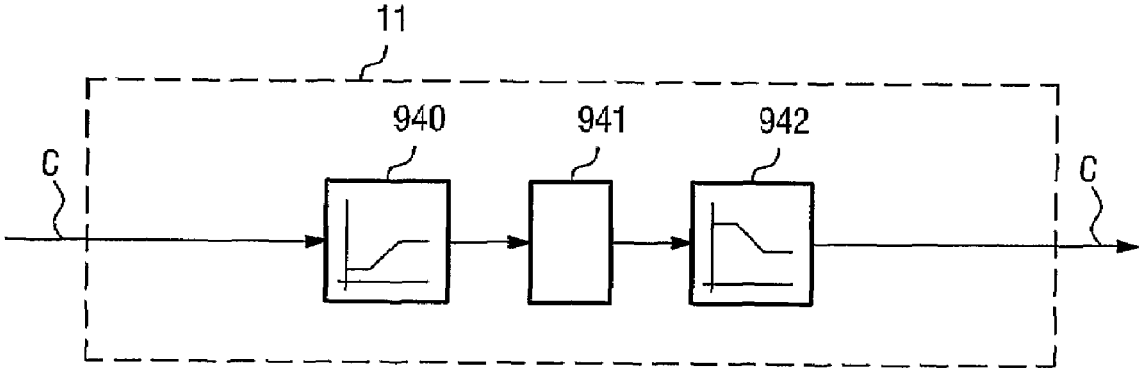
FIG. 6 is a block diagram of a center cross-over and equalization.

Returning to FIG. 2, some further processing of the front F, surround S and center C channels is carried out in a cross-over and equalization blocks 10 and 11, which can be seen in more detail in FIG. 5 and FIG. 6 respectively. These blocks implement the equalization necessary due to the dipole characteristics of the loudspeakers. As shown in FIG. 5, the front channel F is passed though a high-pass filter 920 and two bi-quad filters 921, 922 before scaling in a scaling block 923 and subsequent filtering by a shelving filter 924 to give a modified output signal of the front channel F. Similarly, the rear surround channel S is filtered in a high-pass filter 930 and a subsequent bi-quad filter 931 before being amplified by a gain block 932 to give a modified output signal of the surround channel S. Similar processing is carried out for the center channel C in the cross-over and equalization block 11, where the input center channel C is first passed to a high-pass filter 940 before being scaled in a scaling block 941 and subsequently filtered in a shelving filter 942 to give a modified output signal of the center channel C. Some of the filter blocks described in FIG. 5 and FIG. 6 can be implemented in analogue circuitry, such as the high-pass filters 920, 930, 940 and the scaling filters 924 and 942.

Figure 7:
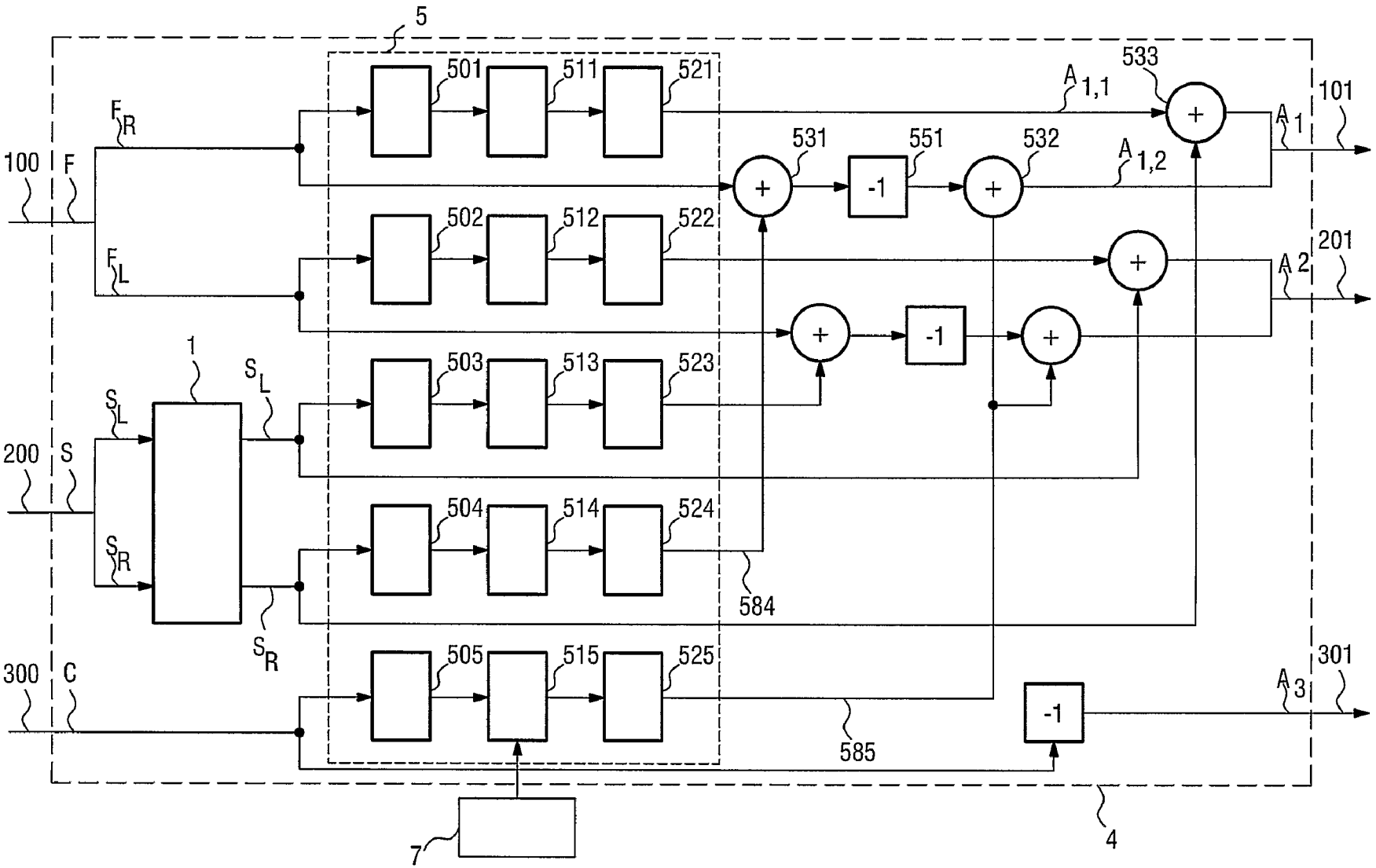
FIG. 7 is a block diagram of a mixing unit in accordance with an embodiment of the present invention.

The final stage of the sound processing system of FIG. 2 is a mixing unit 4, shown in detail in FIG. 7. The purpose of the mixing unit 4 is to mix the sound channels F, S, C, arriving at line inputs 100, 200, 300, in a particular manner to give sound output signals $A_1$, $A_2$, $A_3$ for the amplifiers 15, 16, 17 to achieve the desired acoustic directivity at the loudspeaker arrays. The front and surround channels F, S are separated into their left and right components $F_L$, $F_R$, $S_L$, $S_R$. The left and right components $S_L$, $S_R$ of the surround channel S are first processed in a delay management unit 1, which, since it is essentially the heart of the invention, is described with the aid of several diagrams in more detail below. The output signals of the left and right surround channels $S_L$, $S_R$ of the delay management unit 1 are processed along with the other sound channels $F_L$, $F_R$, $S_L$, $S_R$, C by a user-configurable delay arrangement 5.

The user-configurable delay arrangement 5, which can be configured by the user by means of a user interface 7, comprises a chain of processing units for each of the input signals of the different channels $F_R$, $F_L$, $S_R$, $S_L$, C. Each sound channel $F_R$, $F_L$, $S_R$, $S_L$, C is passed through a delay element 501, 502, 503, 504, 505, a scaling element 511, 512, 513, 514, 515, and a filter 521, 522, 523, 524, 525. The delay elements 501, 502 and 505 are configured to compensate for the additional time required by the delay management unit 1 in processing the signals of the surround $S_R$, $S_L$. The parameters specified by the listener 13 to control the delay elements 501, 502, 503, 504 505 and scale elements 511, 512, 513, 514, 515 influence the angle of directivity of the loudspeaker dipole lobes $DL_1$, $DL_2$, $DL_3$, $DL_4$, $DL_5$, $DL_6$.

The outputs of the user-configurable delay arrangement 5 are mixed by summing and subtracting them together in a particular manner to give the required output channels $A_1$, $A_2$, $A_3$ leaving the mixing unit 4 at its line outputs 101, 201, 301. To illustrate, an output signal 584, derived from the rear surround channel $S_R$, is combined with the signal of the front right channel $F_R$ in the summation element 531. The result is inverted by the element 551 and subtracted from a delayed signal 585 of the center channel C by the element 532 to give a component $A_{1,2}$ of the output channel $A_3$ for the amplifier 15 assigned to the surround loudspeakers L1, R3. The other component $A_{1,1}$ of the output channel $A_2$ is obtained by adding the signal of the right surround channel component $S_R$ to a delayed signal of the front right channel component $F_R$ in the summation element 533.

The output channel $A_2$ for the amplifier 16 assigned to the front loudspeakers L2, R2 is derived in a similar manner. The output channel $A_3$ is derived by merely inverting the input C, since the signals for the loudspeakers L3, R1, used to generate the dipole lobes $DL_3$, $DL_4$ for the center loudspeakers, do not require any contributions from other sound channels.

Figure 8:
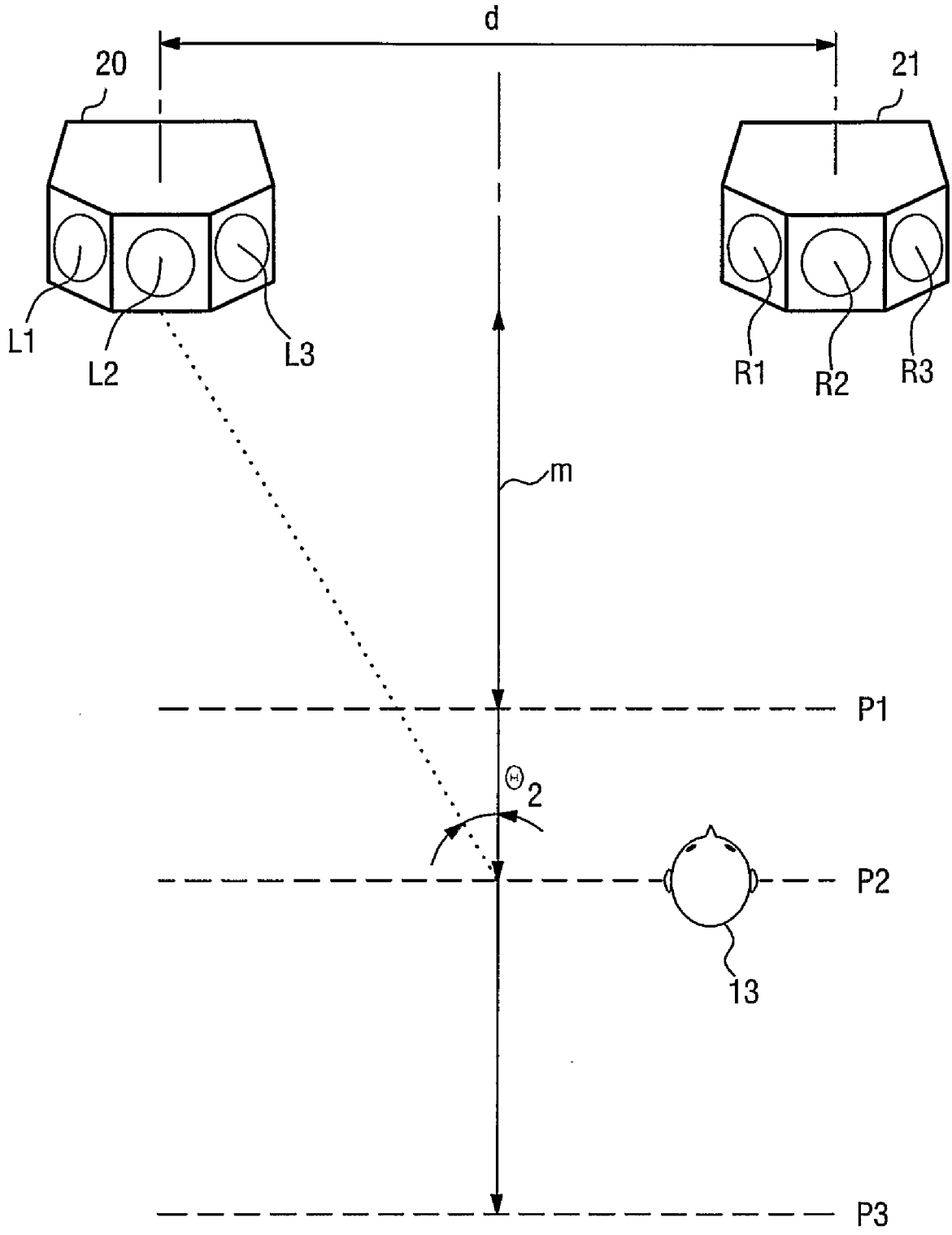
FIG. 8 is a schematic diagram showing a loudspeaker array with various listening positions in accordance with an embodiment of the present invention.

FIG. 8 shows a number of position rows P1, P2, P3 from which the listener can choose. In this example, the loudspeakers 20, 21 are situated in front of the listener. The listener might choose to be seated, for example, along position row $P_2$. The choice of preferred position row might be governed by the dimensions of the room, or the listener might simply wish to be seated at $P_2$ instead of, say, $P_3$. To direct the loudspeaker dipole lobes towards the desired position row $P_2$, the listener enters the necessary information concerning the loudspeaker 20, 21 placement and desired position row $P_2$ by means of the user interface 7. It is sufficient to specify the distance d between the loudspeaker boxes 20, 21, and the distance given by the median m normal to the distance d. The corresponding parameters for the delay and scale elements of the user-configurable delay arrangement 5 are determined by the user interface 7, which calculates the angle of placement $\theta_2$ of the listener 13, and the resulting angles of directivity for the dipole loudspeaker lobes. Once the listener has specified his position in this way, he can enjoy enhanced surround sound perception at any point along the row. Other listeners located along the specified position row can also perceive the enhanced surround sound.

The enhanced surround sound is generated by processing the signal of the rear surround channel S in a dedicated delay management unit 1 before mixing with the other sound channels in the mixing unit 4. This delay management unit 1, which can be realized in a number of ways, is described in detail in FIGS. 9*a*, 9*b* and 9*c*. The purpose of the delay management unit 1 is to decorrelate the left and right components $S_R$, $S_L$ of the surround channel S as much as possible, by delaying them with respect to each other in a continually varying manner.

FIG. 9*a* shows the simplest variation, where the signals of the left and right components $S_L$, $S_R$ of the stereo surround channel S are delayed by separate delay elements $D_1$, $D_2$. A signal source G, which, together with the delay elements $D_1$, $D_2$ comprises the control signal generator 6, supplies a control signal $C_1$. Here, the control signal $C_1$ is in the form of a symmetrical ramp wave, since such a waveform is easy to generate. The signal generator might also generate any other periodical signal, for example a sine or cosine waveform. The delay element $D_1$ interprets the amplitude of the control signal $C_1$ as a delay value, and delays the signal of the component $S_L$ by the appropriate length of time. The maximum amplitude of the control signal $C_1$ corresponds to a maximum delay—in this case 3000 samples—and the minimum amplitude corresponds to no delay at all.

The control signal $C_1$ is modified by a modifier element $M_1$ to give a second control signal $C_2$. The modification involves scaling and/or shifting the control signal C1 to give a control signal $C_2$ which is essentially always different from $C_1$. The delay element $D_2$ interprets the amplitude of the modified control signal $C_2$ as a value of time, and delays the signal of the right channel $S_R$ accordingly.

Since the delays are to all intents and purposes always different, the left and right components $S_L$, $S_R$ of the stereo sound channel S are thereby decorrelated. The period of the waveform generated by the signal generator G is quite large, in this case 50 s, so that the delay oscillates slowly, ensuring that the listener never perceives the surround sound as originating from a static point. Wherever the listener is positioned, he will perceive, over a certain lapse of time, the same mean surround perception as a person located at another spot. Thus, the "sweet spot", at which listening experience is most enjoyable, is effectively spread over a larger area. This means that more than one listener can enjoy an optimal listening experience.

By decorrelating individual frequency bands of the left and right stereo sound channel components $S_L$, $S_R$, an even better listening experience can be given. FIG. 9*b* shows a delay management unit 1 in which each surround signal component $S_L$, $S_R$ is put through a high-pass and a low-pass filter $F_1$, $F_2$, $F'_1$, $F'_2$ thereby splitting each signal component $S_L$, $S_R$ into corresponding frequency bands $B_1$, $B_2$, $B'_1$, $B'_2$. Each frequency band $B_1$, $B_2$, $B'_1$, $B'_2$ is delayed by an amount determined by a corresponding delay element $D_1$, $D_2$, $D'_1$, $D'_2$. Again, a signal generator G is used to supply a control signal $C_1$ in the form of a ramp wave. Again, the maximum amplitude of the control signal $C_1$ corresponds to a maximum delay—in this case 1500 samples—while an amplitude of 0 corresponds to a delay of 0 samples. The control signal passes through a series of modifiers $M_1$, $M_2$, $M_3$, giving a separate control signal $C_1$, $C_2$, $C'_1$, $C'_2$ for each of the delay elements.

The extent to which the control signal is modified is shown in FIG. 10, which shows the outputs $C_1$, $C_2$, $C'_1$, $C'_2$ of the signal generator G and the modifier elements $M_1$, $M_2$, $M_3$. The output of the signal source G is a symmetrical ramp wave $C_1$ with a period of 50 s and an amplitude $\tau_1$ interpreted by $D_1$ to give a maximum delay of 1500 samples. Modifier element $M_1$ modifies control signal $C_1$ by doubling it to give control signal $C_2$, whose amplitude $\tau_2$ is interpreted by delay element $D_2$ to give a corresponding maximum delay of 3000 samples. Modifier element $M_2$ in turn modifies control signal $C_2$ by introducing a phase-shift to give control signal $C'_2$. The amplitude $\tau'_2$ of control signal $C'_2$ is interpreted by delay element $D'_2$ to give the corresponding delay value. A final modifier $M_3$ halves the amplitude of control signal $C'_2$ to give control signal $C'_1$, whose amplitude $\tau'_1$ is interpreted by delay element $D'_1$. Thus, four different values of delay $\tau_1$, $\tau_2$, $\tau'_1$, $\tau'_2$ are used by the delay elements $D_1$, $D_2$, $D'_1$, $D'_2$ to introduce delays in the frequency bands $B_1$, $B_2$, $B'_1$, $B'_2$, which are recombined to give decorrelated stereo signals of the surround channels $S_L$, $S_R$. This example demonstrates a relatively easy and cost-effective way of decorrelating surround channels $S_L$, $S_R$ by using a signal source G to supply a simple waveform $C_1$ and modifying this in an uncomplicated way to yield a number of different control signals $C_2$, $C'_1$, $C'_2$.

The decorrelation can be performed even more thoroughly by splitting the surround channels $S_L$, $S_R$ into a greater number of frequency bands and applying a correspondingly greater number of control signal modifiers and delay elements. An example of such a delay management unit is shown in FIG. 9*c*, where each surround channel $S_L$, $S_R$ is split into n frequency bands by means of appropriate band-pass filters $B_1, B_2, \ldots, B_n, B'_1, B'_2, \ldots, B'_n$ to give frequency bands $F_1, F_2, \ldots, F_n, F'_1, F'_2, \ldots, F'_n$. As in the previous examples, each frequency band is delayed by a dedicated delay element $D_1, D_2, \ldots, D_n, D'_1, D'_2, \ldots, D'_n$ controlled by the corresponding control signal $C_1, C_2, \ldots, C_n, C'_1, C'_2, \ldots, C'_n$. The signal generator G supplies the control signal $C_1$ from which the remaining control signals are derived by the modifiers $M_1, M_2, \ldots, M_n$. The delayed frequency bands are recombined to give the decorrelated output signals for the surround channels $S_L$, $S_R$. Since this is a considerably more complicated example, such a realization is more suited to particularly high-end devices.

A number of possible loudspeaker arrangements for a listening position are shown in FIG. 11*a*, 11*b*, 11*c*, 11*d* and 11*e*.

Figure 11A:
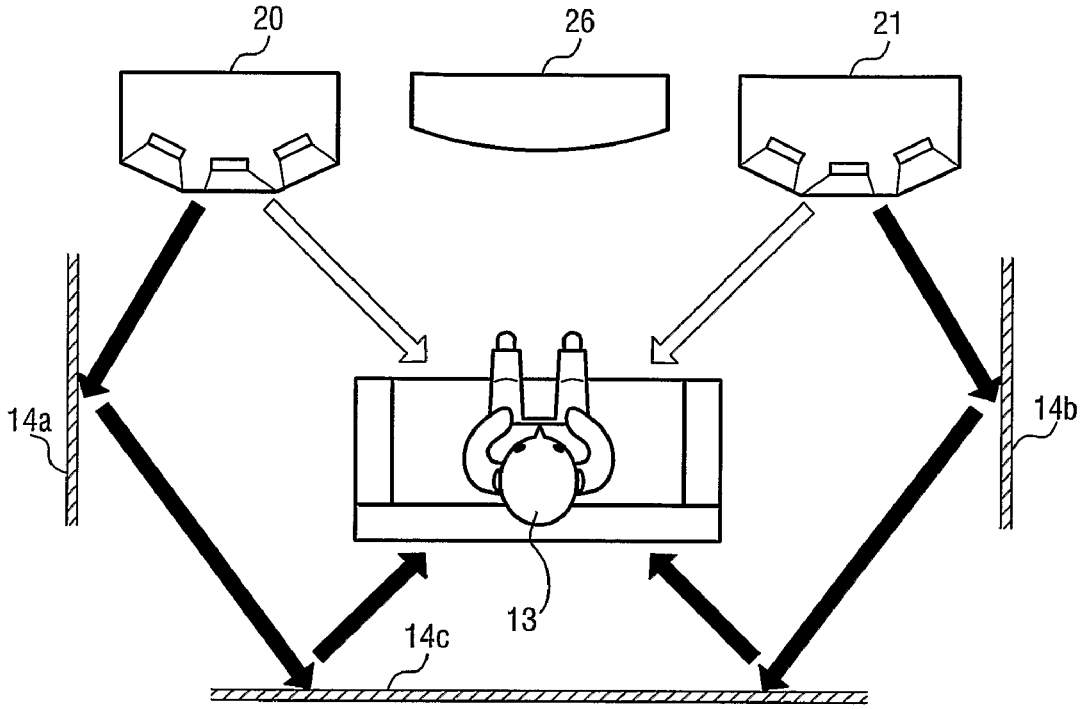

In FIG. 11*a*, loudspeaker boxes 20, 21 are positioned in front of the listener 13, and to his left and right. The sound reproduced by the loudspeakers in the boxes 20, 21 originate in this example from a home entertainment device 26 such as a television or hi-fi system. The acoustic system which supplies the sound signals for the loudspeakers in the boxes 20, 21 might be incorporated in the home entertainment device 26, or may be located elsewhere. The signals are mixed in the acoustic system to give dipole directivity for the loudspeaker drivers, so that front and center channels are directed towards the listener 13, while the surround channel is directed towards the walls 14*a*, 14*b* to the left and right of the listener. The sound waves produced by the speakers in the boxes 20, 21 are then reflected off the side walls 14*a*, 14*b* in such a manner as to travel towards the wall 14*c* behind the listener 13, where they are reflected once more so that they now travel towards the listener 13.

Figure 11B:
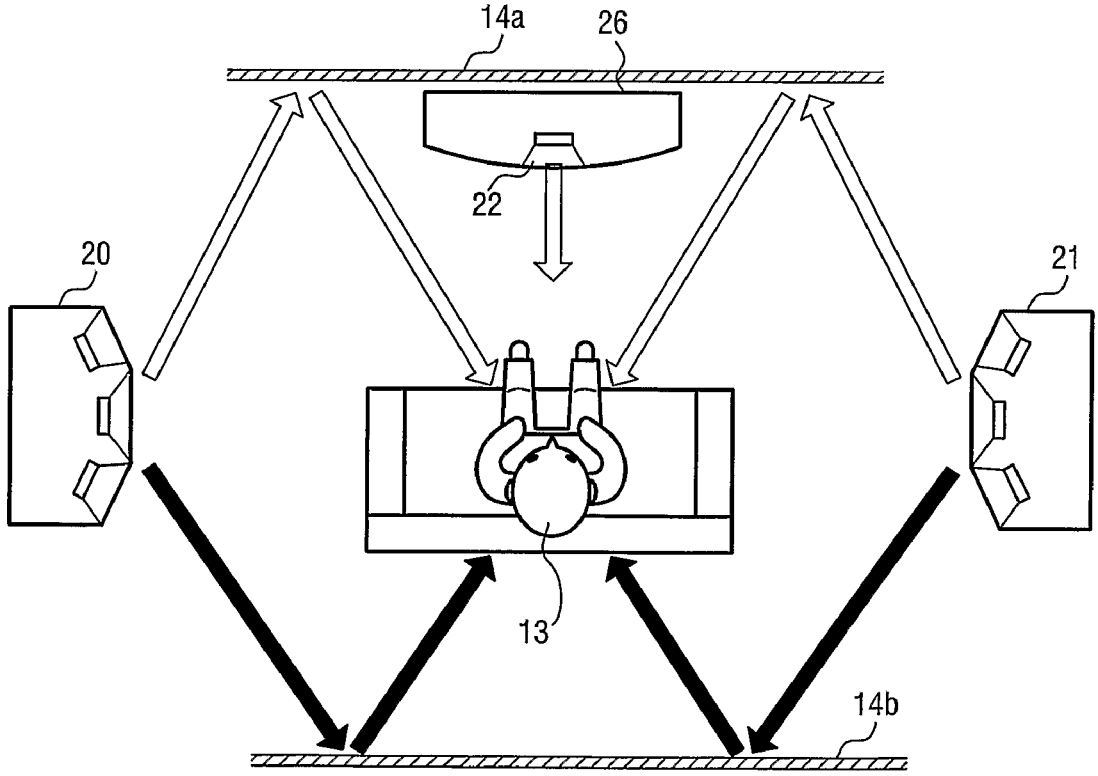

In FIG. 11*b*, the loudspeakers boxes 20, 21 are this time positioned to the left and right of the listener 13 respectively. In this example, the home entertainment device 26 incorporates a loudspeaker 22, for example a subwoofer for the bass signals. The sound produced from the subwoofer 22 travels directly towards the listener 13. The sound produced by the loudspeakers in the boxes 20, 21 comprising front and center channels is directed towards the wall 14*a* in front of the listener 13, where the sound waves are reflected before traveling back to the listener 13. Similarly, the sound produced by the loudspeakers in the boxes 20, 21 comprising the surround channel is directed towards the wall 14*b* behind the listener 13, where the sound waves are reflected before reaching the listener 13.

Figure 11C:
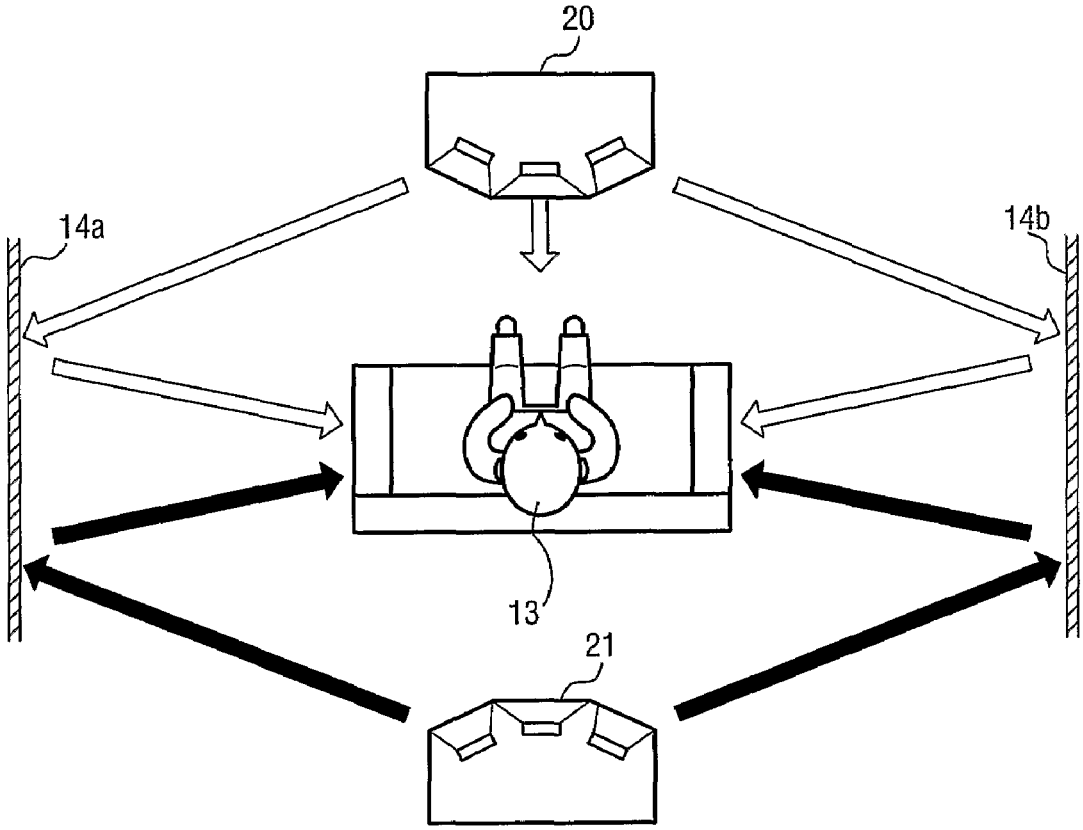

In FIG. 11*c*, loudspeakers in two boxes 20, 21 direct sound towards the walls 14*a*, 14*b* to the left and right of the listener 13. The drivers in box 20 direct the sound comprising front and center channels towards the walls 14*a*, 14*b* where it is reflected before traveling back towards the listener 13. In the same way, the drivers in box 21, used to convert the surround channel to sound and positioned behind the listener 13, also direct sound output towards the side walls 14*a*, 14*b* where it is reflected before reaching the listener 13.

Figure 11D:
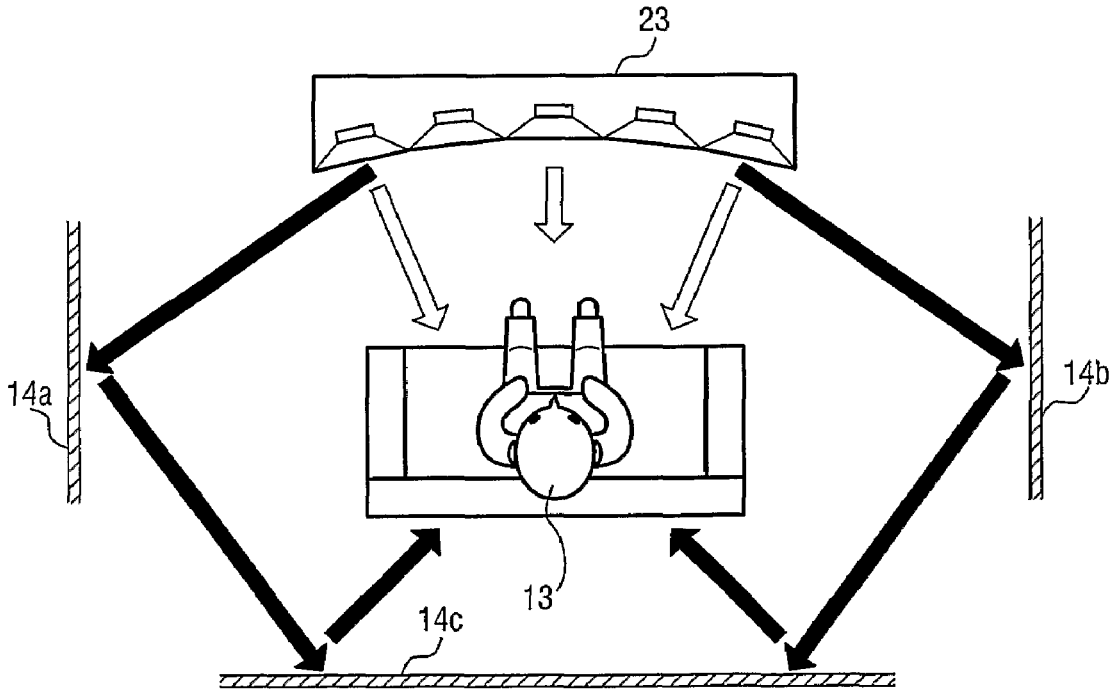

A loudspeaker arrangement using only one box 23 is shown in FIG. 11*d*. Here, all the loudspeakers required for converting center, front and surround channels to sound are housed in the same box 23. A center driver direct the bass sound output towards the listener 13. The other drivers direct the front sound output towards the listener 13 from his left and right, and direct the surround sound output towards the side walls 14*a*, 14*b*, where the sound waves are reflected before reaching the listener 13.

Figure 11E:
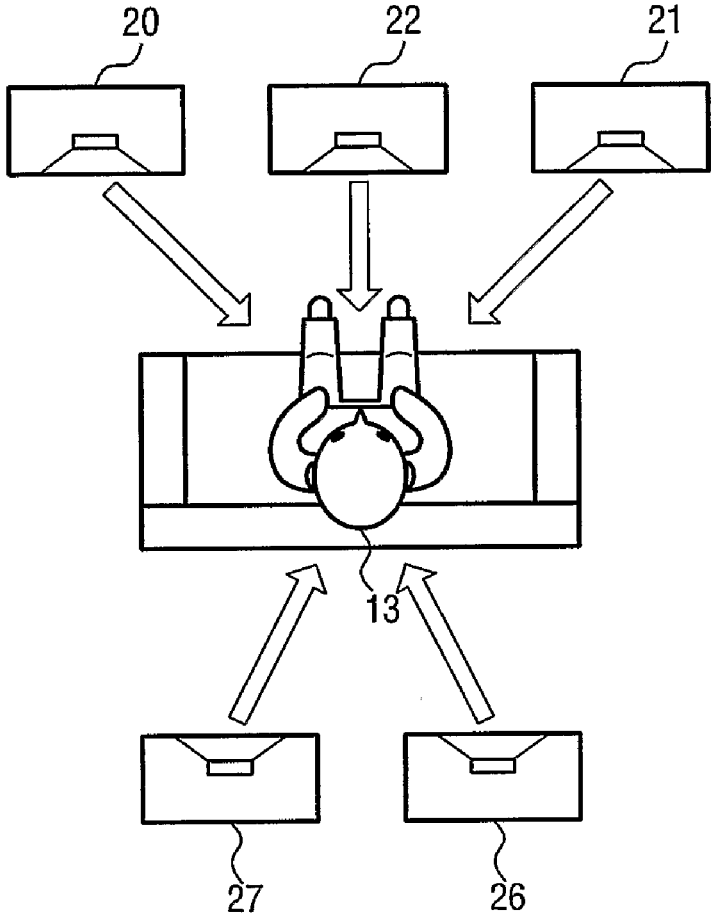

A last example is given in FIG. 11*e*, showing an arrangement of 5 loudspeaker boxes 20, 21, 22, 26, 27 positioned all around the listener 13. Here, the loudspeaker in box 22 directs the bass channel sound towards the listener 13. Drivers in boxes 20, 21 direct the front and center channel sound towards the listener 13 from his left and right. Two further boxes 26, 27, positioned behind the listener 13, direct the rear or surround sound directly towards the listener 13 from behind.

Surround sound, enhanced by a method according to the invention, can be produced for immediate listening in an acoustic system in a home environment, for surround sound signals originating from a hi-fi or TV. Alternatively, the enhanced surround sound signals can be produced for a sound-track or similar in a sound studio environment prior to conversion into a form suitable for storing on a memory storage medium. A considerable advantage of the invention is that, even if a listener does not avail of an acoustic system incorporating a delay management unit as described above, he can still enjoy the enhanced surround sound reproduced by his acoustic system using the sound signals played from the memory storage medium.

FIG. 12 shows a sound processing system 2' for generating enhanced surround signals, in this case in a sound studio. The sound input channels F, S, C and B, have been recorded in the usual manner to give to front, surround, center and bass sound channels. The recording might be, for example a movie soundtrack. The surround channel signals $S_L$, $S_R$ are processed in a delay management unit 1 according to the invention to give sound output signals for the surround channels $S_L$, $S_R$ which are recorded with the other channels F, C and B in a recording device 28. The recording, which can be in a format such as Dolby Digital 5.1, etc., can then be stored, generally in digital form, on a memory storage medium 29 such as CD-Rom, DVD, video tape, hard-disk, movie reel etc. The memory storage medium 29 might be incorporated on a server to allow downloading of the recording from, for example, an internet shop. The recording can then be played on a home entertainment device, where the sound channels can be mixed to give the desired directivity.

Alternatively, the enhanced sound signals might also be produced in a home acoustic system before converting to a form suitable for storing. The signals might then be written to a memory storage medium, for example by burning a DVD or writing to a video cassette tape.

Although the present invention has been disclosed in the form of preferred embodiments and variations thereon, it will be understood that numerous additional modifications and variations could be made thereto without departing from the scope of the invention. The number of loudspeaker boxes and the number of drivers in each array depends to a large extent on the environment in which the acoustic system is used. In a home environment, for example, a relatively large number of loudspeakers might be used, whereas in an automobile, the loudspeakers are generally located in the doors or in the cockpit, so the choice of loudspeaker in such an acoustic system is generally limited by the relevant dimensions.

For the sake of clarity, it is also to be understood that the use of "a" or "an" throughout this application does not exclude a plurality, and "comprising" does not exclude other steps or elements. A "unit" or "module" may comprise a number of blocks or devices, unless explicitly described as a single entity. The term "hardware" can mean digital or analogue hardware, and might mean any type of circuitry such as boards, integrated circuits, off-the-shelf modules, custom modules etc.

The invention claimed is:

1. A method, executing on hardware, for processing sound signals for a surround left channel ($S_L$) and a surround right channel ($S_R$), comprising the steps of:

generating a continually varying delay between the signals of the surround right channel ($S_R$) and the surround left channel ($S_L$), wherein the continually varying delay decorrelates the surround left channel ($S_L$) and the surround right channel ($S_R$), and wherein the continually varying delay varies over time so as not to have a fixed value;

processing the signals of the surround left channel ($S_L$), wherein processing of the signals of the surround left channel ($S_L$) includes the step of introducing a first delay to the signals of the surround left channel ($S_L$); and processing the signals of the surround right channel ($S_R$), wherein processing of the signals of the surround right channel ($S_R$) includes the step of introducing a second delay to the signals of the surround right channel ($S_R$), wherein the first delay and the second delay provide the continually varying delay between the signals of the surround right channel ($S_R$) and the surround left channel ($S_L$).

2. A method according to claim 1, wherein the left surround channel ($S_L$) and the right surround channel ($S_R$) are each split into a number of frequency bands ($B_1$, $B_2$, . . . , $B_n$, $B'_1$, $B'_2$, . . . , $B'_n$), and each frequency band ($B_1$, $B_2$, . . . , $B_n$, $B'_1$, $B'_2$, . . . , $B'_n$) 1 of each surround channel ($S_R$, $S_L$) is delayed with respect to other frequency bands ($B_1$, $B_2$, . . . , $B_n$, $B'_1$, $B'_2$, . . . , $B'_n$) of the same channel ($S_R$, $S_L$), and also with respect to a corresponding frequency band ($B'_1$, $B'_2$, . . . , $B'_n$, $B_1$, $B_2$, . . . , $B_n$) of the other channel ($S_L$, $S_R$).

3. A method according to claim 1, wherein the surround left channel ($S_L$) and the surround right channel ($S_R$) are mixed with other sound channels ($F_R$, $F_L$, C) and forwarded to a number of loudspeakers (L1, L2, L3, R1, R2, R3) in such a way as to yield sound output signals ($A_1$, $A_2$, $A_3$, $A_4$) with a directional arrangement of dipole loudspeaker lobes ($DL_1$, $DL_2$, $DL_3$, $DL_4$, $DL_5$, $DL_6$).

4. A method according to claim 1, wherein the delayed surround channels ($S_L$, $S_R$) are stored together with associated sound ($F_R$, $F_L$, C, B) and/or video channels in a storage media for later use.

5. A delay management unit (1) hardware device for processing a surround right channel ($S_R$) and a surround left channel ($S_L$) of a stereo surround channel (S), wherein the delay management unit (1) comprises:

a number of variable delay units ($D_1$, $D_2$, . . . , $D_n$, $D'_1$, $D'_2$, . . . , $D'_n$) to provide a continually varying delay between the signals of the surround right channel ($S_R$) and the surround left channel ($S_L$), wherein the continually varying delay decorrelates the surround left channel ($S_L$) and the surround right channel ($S_R$), and wherein continually varying delay varies over time so as not to have a fixed value.

6. A delay management unit (1) according to claim 5, comprising variable delay units ($D_1$, $D_2$, . . . , $D_n$, $D'_1$, $D'_2$, . . . , $D'_n$) in each surround channel ($S_L$, $S_R$) and a control signal generator (6) with control signal outputs ($C_1$, $C_2$, . . . , $C_n$, $C'_1$, $C'_2$, . . . , $C'_n$) connected to the variable delay units ($D_1$, $D_2$, . . . , $D_n$, $D'_1$, $D'_2$, . . . , $D'_n$) in such a way as to yield the continually varying delay.

7. A delay management unit (1) according to claim 5, comprising:

a frequency splitting arrangement for the left surround channel ($S_L$) and for the right surround channel ($S_R$) to split each channel into a number of frequency bands ($B_1$, $B_2$, . . . , $B_n$, $B'_1$, $B'_2$, . . . , $B'_n$);

variable delay units ($D_1$, $D_2$, . . . , $D_n$, $D'_1$, $D'_2$, . . . , $D'_n$) for the different frequency bands ($B_1$, $B_2$, . . . , $B_n$, $B'_1$, $B'_2$, . . . , $B'_n$) in the surround right channel ($S_R$) and the surround left channel ($S_L$); and a control signal generator (6) for generating control signals ($C_1$, $C_2$, . . . , $C_{n-1}$, $C'_1$, $C'_2$, . . . , $C'_{n-1}$) to control the variable delays ($D_1$, $D_2$, . . . , $D_n$, $D'_1$, $D'_2$, . . . , $D'_n$) in such a way as to delay each frequency band ($B_1$, $B_2$, . . . , $B_n$, $B'_1$, $B'_2$, . . . , $B'_n$) of each surround channel ($S_L$, $S_R$) with a continually varying delay with respect to other frequency bands ($B_1$, $B_2$, . . . , $B_n$, $B'_1$, $B'_2$, . . . , $B'_n$) of the same channel ($S_L$, $S_R$), and with respect to a corresponding frequency band ($B'_1$, $B'_2$, . . . , $B'_n$, $B_1$, $B_2$, . . . , $B_n$) of the other channel ($S_R$, $S_L$).

8. A delay management unit (1) according to claim 6, where the control signal generator (6) comprises a signal source (G) and a signal modifier arrangement ($M_1$, $M_2$, . . . $M_{n-1}$) which together provide control inputs ($C_1$, $C_2$, . . . , $C_{n-1}$, $C'_1$, $C'_2$, . . . , $C'_n$) for the delay units ($D_1$, $D_2$, . . . , $D_n$, $D'_1$, $D'_2$, . . . , $D'_n$).

9. The delay management unit of claim 5, wherein the delay management unit is part of a sound processing system (2, 2').

10. An acoustic system (3), said system comprising:

a source of a number of distinct sound channels (F, S, C, B) including a surround left channel ($S_L$) and a surround right channel ($S_R$);

a sound processing system (2) according to claim 9 for processing the sound channels (F, S, C, B);

and a number of loudspeakers (L1, L2, L3, R1, R2, R3) for converting the processed sound channels ($A_1$, $A_2$, $A_3$, $A_4$) into audible sound.

11. An acoustic system (3) according to claim 10, where the number of loudspeakers (L1, L2, L3, R1, R2, R3) are arranged to form an array and where the sound processing system (2) comprises a mixing unit (4) for mixing sound input channels (F, S, C) to give sound output channels ($A_1$, $A_2$, $A_3$,), and forwarding sound output channels ($A_1$, $A_2$, $A_3$, $A_4$) to the loudspeakers (L1, L2, L3, R1, R2, R3) in such a way as to yield a directional arrangement of dipole loudspeaker lobes ($DL_1$, $DL_2$, $DL_3$, $DL_4$, $DL_5$, $DL_6$) for the sound input channels (F, S, C, B).

12. A mixing unit (4) for a sound processing system (2) with a number of distinct sound channels (F, S, C) including a surround left channel ($S_L$) and a surround right channel ($S_R$) comprising:

line inputs (100, 200, 300) for the sound channels (F, S, C);

line outputs (101, 201, 301) for connection to loudspeakers (L1, L2, L3, R1, R2, R3);

a means for mixing the sound channels (F, S, C) to give sound output channels ($A_1$, $A_2$, $A_3$) in such a way as to yield a directional arrangement of dipole loudspeaker lobes ($DL_1$, $DL_2$, $DL_3$, $DL_4$, $DL_5$, $DL_6$) and forwarding the sound output channels ($A_1$, $A_2$, $A_3$) to the line outputs (103, 203, 303); and a delay management unit (1) according to claim 6 to generate a continually varying delay between the surround right and surround left channels ($S_R$, $S_L$).

13. A mixing unit (4) according to claim 12, comprising a user-configurable delay arrangement (5) for delaying the signals of the different sound channels ($F_R$, $F_L$, $S_R$, $S_L$, C) with respect to each other in such a way as to direct dipole loudspeaker lobes ($DL_1$, $DL_2$, $DL_3$, $DL_4$, $DL_5$, $DL_6$) for at least some of the sound channels ($F_R$, $F_L$, $S_R$, $S_L$, C) by choosing suitable delay scale values.

14. A studio system comprising a sound processing system (2') according to claim 9.

* * * * *